US006141911A

United States Patent [19]

Reid

[11] Patent Number: 6,141,911

[45] Date of Patent: Nov. 7, 2000

[54] PET DOOR

[75] Inventor: Alister Peter Reid, London, United Kingdom

[73] Assignee: Graham Watt & Company, Sevenoaks, United Kingdom

[21] Appl. No.: 09/156,455

[22] Filed: Sep. 18, 1998

[30] Foreign Application Priority Data

Feb. 9, 1998 [GB] United Kingdom ..... 9802693

[51] Int. Cl.[7] ..... E05B 65/06; E05D 15/48; E05F 11/52

[52] U.S. Cl. ..... 49/394; 49/169; 74/89.14; 292/142

[58] Field of Search ..... 49/169, 168, 394; 160/180, 116, 181; 292/142, 160, 144; 74/89.14, 89.17

[56] References Cited

U.S. PATENT DOCUMENTS 4,497,133 2/1985 Blenkinsop ..... 49/169 X
4,619,151 10/1986 Trachman et al. ..... 74/89.14 X
5,196,826 3/1993 Whiting ..... 49/31 X
5,791,179 8/1998 Brask ..... 292/142 X

*Primary Examiner*—Daniel P. Stodola
*Assistant Examiner*—Hugh B. Thompson
*Attorney, Agent, or Firm*—Dority & Manning, P.A.

[57] ABSTRACT

A pet door having a pair of bolt assemblies with bolts (28) mounted in a frame having an aperture (6) in which a door flap (18) is pivotably mounted. The bolts (28) are extendable into the door flap (18) and retractable into the frame (2) to lock and unlock the pet door, respectively. A bolt mechanism controller (50) is arranged to unlock the pet door on detection of a pet carrying the correct key transmitter (66) and to relock the pet door a user adjustable predetermined time after unlocking the pet door. This provides a pet door which can be used to automatically permit entry to a selected pet while using a robust bolt (28) of especial application to larger pet doors such as dog doors.

18 Claims, 3 Drawing Sheets

PET DOOR

The present invention relates to pet doors and is of particular application to pet doors for larger animals such as dogs.

Pets doors are often fitted in the doors or walls of a building to allow a pet to enter or leave without the need for assistance by their owner. Pet doors which allow only specific pets through the door are known which only unlock to allow the animal to pass through if it is carrying an appropriate key. Examples as such known so-called "selective" pet doors are disclosed in EP-A-0 736 654, GB-A-2,119,431 and GB-A-2,305,211.

A common feature of these known pet doors is that they each include a vertically hanging door flap mounted in a support frame and a latch mounted in the lower portion of the frame. The latch is arranged so that in the normal position it abuts one lower side of the flap and is configured to allow the flap to open in one direction away from the latch but not in the other direction. Any animal can, for example, exit a building through such a pet door but cannot enter again unless it carries the correct key.

The correct key activates the latch to retract it into the frame so allowing the flap to open in the previously barred direction to allow the animal to pass through. The latch is reset after a short time and it is constructed so that when reset the flap can depress the latch as it swings back over the latch from the open position to reassume the locked position once more.

Such pet doors are suitable for smaller pet doors, for example when dimensioned for domestic cats, but not for most uses of larger pet doors for use by dogs, for example. This is because the flap must be releasably locked against opening in both directions to prevent any children leaving a house through the pet door and to prevent someone outside the house pulling the flap outward to gain unauthorised access to the inside of the house. While it is possible to provide a pair of known latches each positioned to latch the flap in one of the two opening directions, the resulting construction would be relatively complex and expensive.

The present invention seeks to provide a selective pet door which addresses these disadvantages of the prior art pet doors.

Accordingly there is provided a selectively operable pet door including a door flap pivotably mounted in an aperture of a frame, a bolt mechanism mounted in the frame which is moveable between a locked condition in which the door flap is bolted against opening and an unlocked condition in which the door is free to be opened, and a bolt mechanism controller which includes means for detecting a pet permitted to pass through the pet door and which is arranged to move the bolt mechanism to the unlocked condition on detecting the presence of such a pet and to automatically move the bolt mechanism back to the locked condition a predetermined time period after being moved to the unlocked condition, the predetermined time period being adjustable by the user.

The use of a bolt mechanism provides a robust locking mechanism which prevents the door flap from opening in either direction when locked. The use of such a mechanism, which does not have a latch and so requires the door flap to be in the vertical position when the bolt mechanism is thrown, is made possible by the use of the novel bolt mechanism controller of the present invention which automatically relocks the door flap a predetermined period after unlocking the door flap. The predetermined period is adjustable by the user to have a value which, for their pet, experience shows gives enough time for the pet to pass through and for the door flap to subsequently resume the vertical position so that the bolt mechanism will engage the door correctly to lock it in the vertical position. If a suffient delay is not provided, the bolts could be thrown before the door flap comes to rest in the vertical position and with the door flap one side or other of the bolts. It would then be openable in one direction even though the bolts were thrown.

Preferably, the bolt mechanism controller is arranged to move the bolt mechanism from the locked condition to the unlocked condition a second predetermined period after expiry of the above mentioned predetermined period, for example 60 seconds, and to move it back to the locked condition a predetermined time period, for example 1 second. These actions will lock the door flap if for reason the door flap should come to rest against the bolt mechanism, for example if the animal hesitated on its way through the door flap.

The bolt mechanism may include first and second bolt assemblies mounted on opposite sides of the vertical centre line of the frame, for example. Conveniently, each such bolt assembly may include a bolt movable to bolt and unbolt the door flap by a respective electric motor. For example, each bolt may have a portion formed as a rack in engagement with a pinion and the pinion in turn arranged to be rotatable by a screw gear fixed to the shaft drive of the motor.

Preferably, such bolt assemblies are identical to reduce the number of different manufactured subassemblies.

In a particularly preferred embodiment, the bolt mechanism controller includes a tuned receiver for receiving a signal transmitted by a key transmitter worn by a pet, and a microprocessor arranged to determine from the received signal if the signal is transmitted by a key which is permitted to unbolt the pet door.

This arrangement may employ an active transmitter key to provide a pet door which unlocks when the key is a greater distance from the pet door than known selective operable pet doors which use passive keys.

The microprocessor of such an embodiment may be arranged to determine if a received digitally encoded key signal is transmitted by a key permitted to unbolt the pet door. The key may, for example, modulate a carrier radio frequency with a modulated digital signal being one of a number of combinations, the number being chosen so as to make it unlikely that a neighbour's pet with a similar key will have the same key combination.

Conveniently, the length of the predetermined time is adjustable by the user between a predetermined minimum value and a predetermined maximum value, inclusively, for example the predetermined minimum and maximum values may be 5 seconds and 60 seconds, respectively.

Fixed limits prevent the user inadvertently setting the predetermined time to one which is unusually short or could allow the user to set the controller so it would leave the pet door unlocked for a considerable period of time.

The microprocessor may be coupled to a user accessible keypad by which the predetermined time period is adjustable. The keypad may, for example, include a first key and a second key, the predetermined time limit being increased by pressing the first key and decreased by pressing the second key.

An embodiment of the invention will now be described, by way of example only, with reference to the accompanying drawings, in which:

FIG. 1 shows the rear side of a first frame 2 of a pet door according to the present invention, dimensioned to allow a dog to pass through. The rear side of frame of FIG. 1 faces the interior of the door to which it is to be mounted and is complemented by a second frame (not shown) mounted on the exterior of the door to which the pet door is to be mounted.

Figure 1:
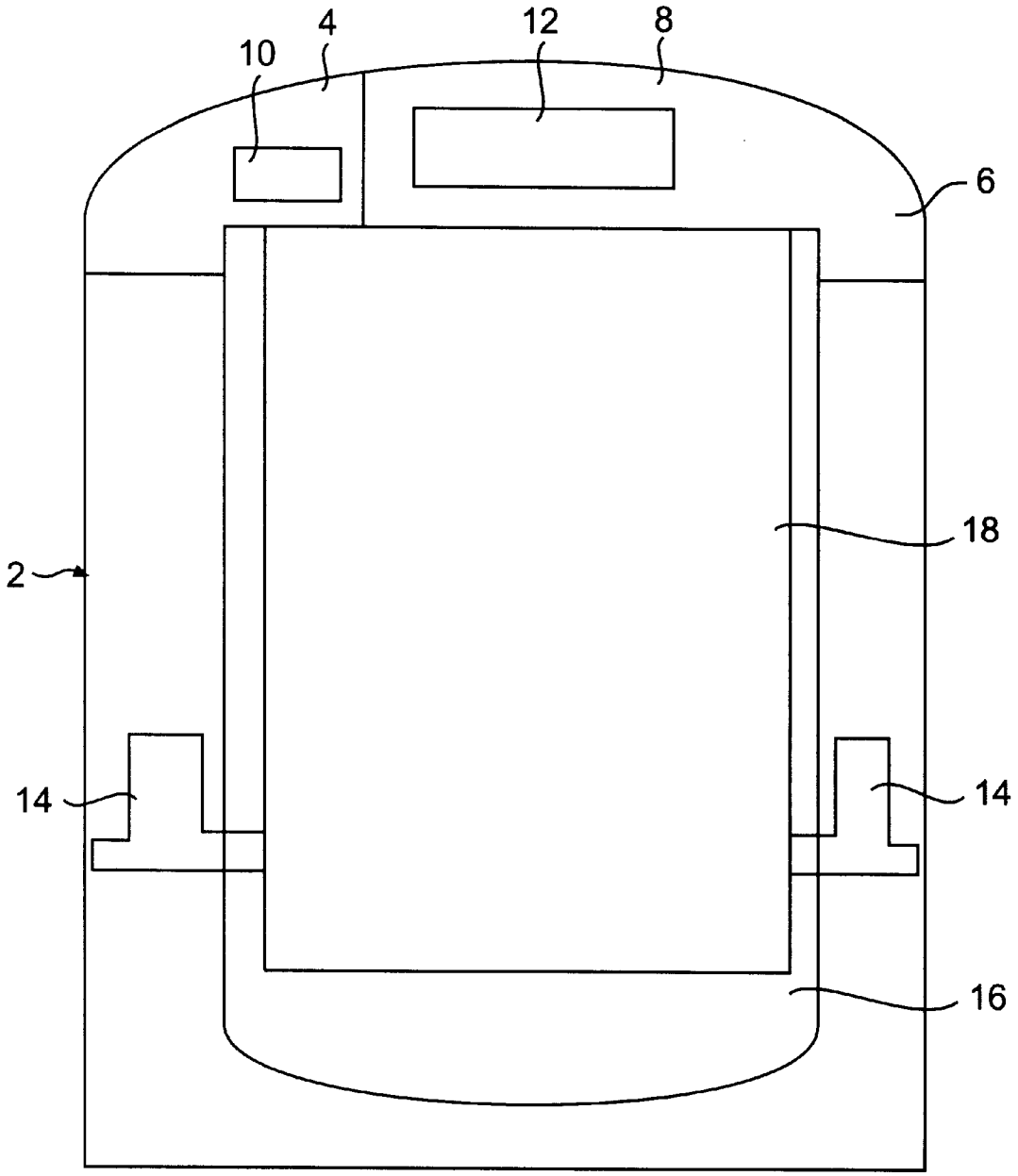
FIG. 1 is a schematic rear view of one piece of a two-piece frame with a mounted flap of pet door of an embodiment of the present invention.

The frame 2 includes a left corner compartment 4, right corner compartment 6 and battery compartment 8 in which the components of a bolt mechanism controller 10 and battery power supply 12 are fitted.

Bolt mechanism compartments 14 are formed in the frame 2 at opposite sides of the frame to hold bolt mechanisms (not shown) as will be described with reference to FIGS. 2 and 3.

An aperture 16 in the centre of the frame 2 is defined by a U-piece portion of the frame and the lower sides of the corner end battery compartments 4, 6.

A door flap 18 fills the aperture and is pivotally mounted to the frame at the top of the door flap so it can, when unlocked, be pushed open by the pet in both rotational directions from the resting vertical position of FIG. 1.

Figure 2:
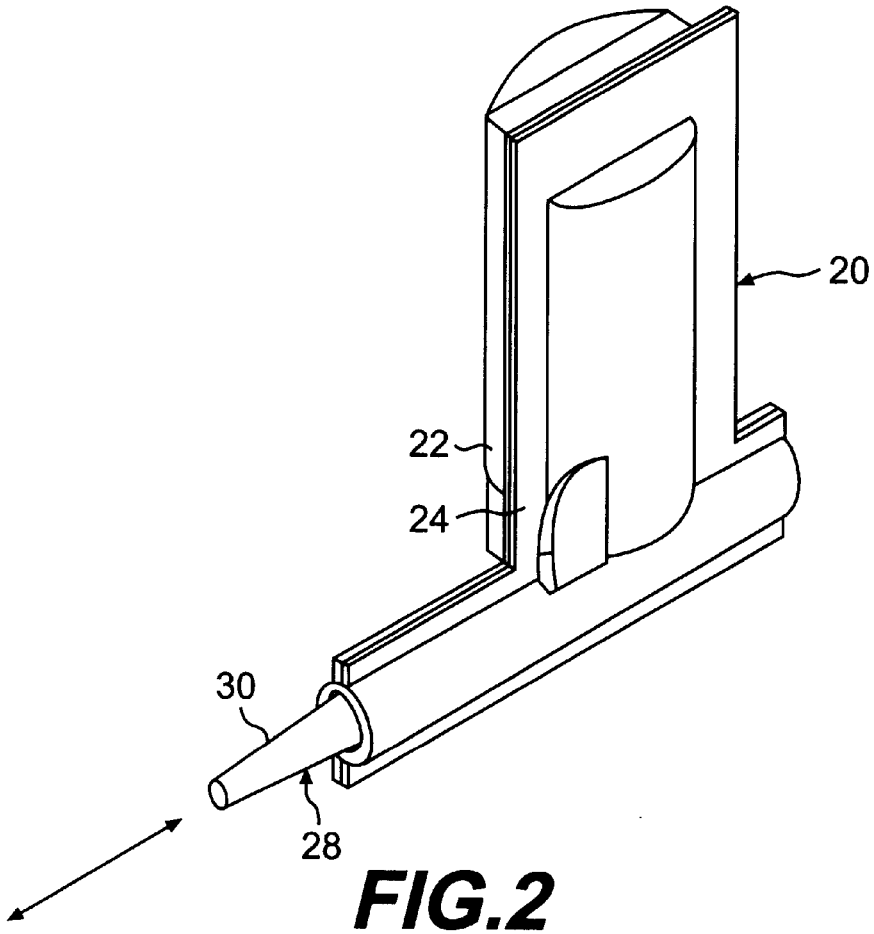
FIG. 2 is a perspective view of one lock mechanism of the pet door of FIG. 1.
Figure 3:
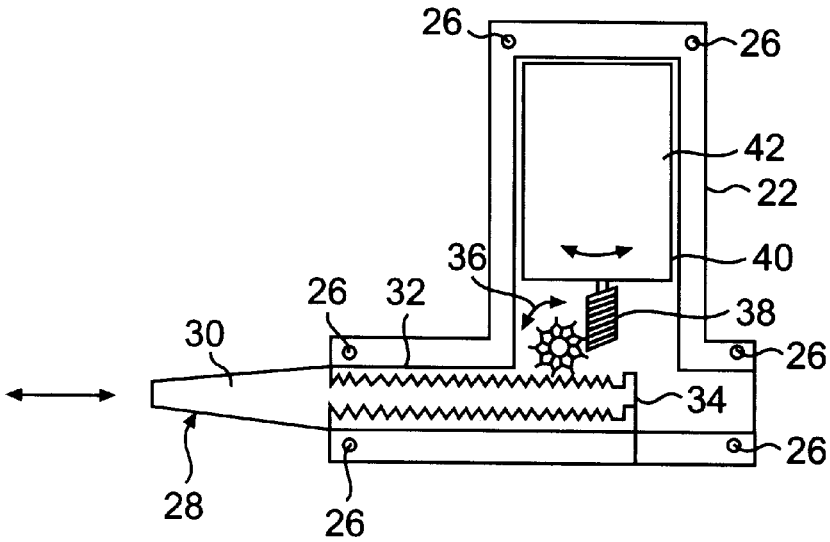
FIG. 3 is a schematic cross-sectional view of the lock mechanism of FIG. 2.

Referring now to FIGS. 2 and 3, a bolt mechanism dimensioned to be fitted within a bolt mechanism compartment 14 has a two-piece housing 20 with housing portions 22 and 24 held together by stud-hole fittings round their periphery. See FIG. 3 which shows studs 26 of housing portion 22 each a push-fit in a corresponding hole (not shown) in housing portion 24. A bolt 28 is received in housing and has a blunt ended, tapered, end portion 30. The use of a tapered bolt end portion 30 allows the bolt 28 to enter and so lock the door flap 18 if for some reason it comes to rest slightly misaligned from the true vertical.

The remainder of the bolt includes an exterior threaded portion and a non-threaded guard ring 34 at the end of the bolt distal the tapered portion 30. The threaded portion 32 of the bolt 28 is engaged with a pinion 36 rotatably mounted on the housing 22 and rotatable by a helical worm gear 38 fixed to a drive shaft 40 of a DC electric motor 42. The end portion 30 and guard ring 34 limit the extent of movement of the bolt 28.

Rotation of the drive shaft 40 in a first sense will drive the bolt 28 to extend from the housing 20 to engage with a respective bolt hole (not shown) formed in the side of the door flap 18 so locking it in place. A rotation in the opposite sense will drive the bolt 28 to retract into the housing 20 so unlocking the door flap 18.

Figure 4:
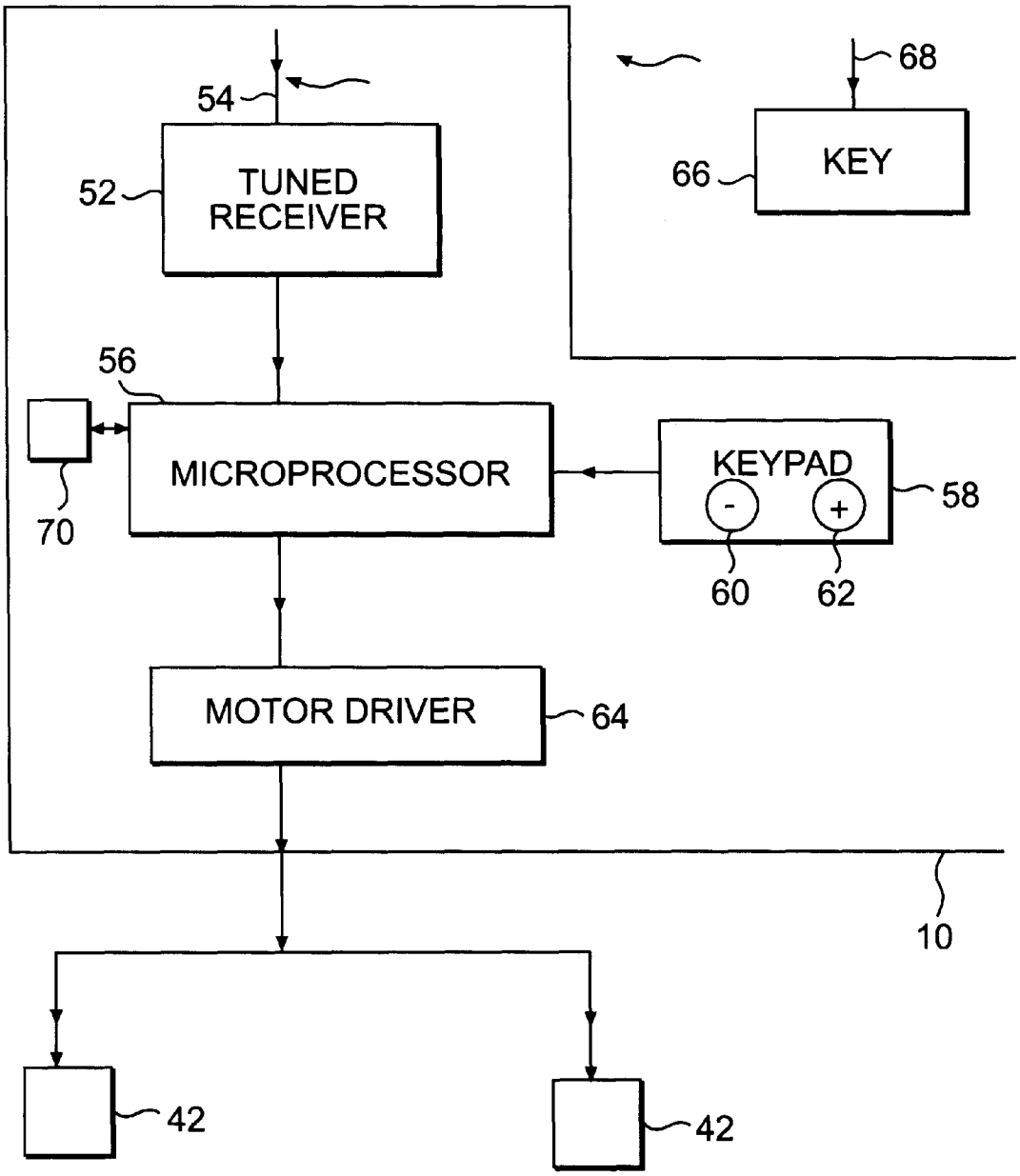
FIG. 4 is a block circuit diagram of an embodiment of the controller locking mechanism of the present invention.

Referring now to the schematic of FIG. 4, a bolt mechanism controller 10 includes a tuned receiver 52 connected to an aerial 54, (in this embodiment a loop of wire (not shown) set in the frame 2) whose output is coupled to a microprocessor 56. The microprocessor is also coupled to a keypad 58 with keys 60 and 62.

The microprocessor is also coupled to a motor driver circuit 64 which is controllable by the microprocessor to drive motor 42 of the bolt mechanisms to drive both bolts 28 of the pet door together into or out of their respective housing 20.

A key transmitter 66, held on the collar of the pet, for example, transmits digitally modulated radio signal via aerial 68 for reception by the tuned receiver 52 when close enough to it, for example 1 to 2 meters, but at a sufficient distance to be detected before the pet's muzzle touches the flap.

This embodiment operates as follows. The tuned receiver receives the digitally modulated signal from the key transmitter 66 when it is close enough. The microprocessor 56 analyses the received signal in known fashion to determine if the digital modulated key matches one of one or more keys stored in a memory means 70 coupled to the microprocessor 56.

If there is a match, the microprocessor activates the motor driver 64 to output a drive signal to the motors 42 timed to continue for a sufficient period of time to cause the bolts 28 to fully retract into their respective housing 20 so unbolting the pet door. The pet can then pass through the pet door.

The microprocessor is arranged to then activate the motor driver 64 to output a drive signal of reverse polarity after a further predetermined time period and for a sufficient time to cause the bolts 28 to fully extend from their respective housings 20. It is assumed the door will have reassumed a vertical orientation by this time and so be locked in this vertical orientation by the bolts 28.

The predetermined period between activating the motors 42 to throw the bolts after their initial retraction is determined by the microprocessor by means of a counter with reference to a stored value. The user can decrease or increase the period by pressing key 60 or 62 of the key pad, respectively, which keys are monitored by the microprocessor and which adjusts the stored value appropriately. In this embodiment the microprocessor is arranged to ensure the stored value can only take values corresponding to predetermined periods from 5 to 60 seconds, inclusively.

After a further 60 seconds the bolts 28 are withdrawn into the frame 2 for 1 second and rethrown. This allows the door flap 18 to move to the vertical position to be locked in place if, for some reason, the door flap 18 comes to rest against the bolts 28 and would otherwise not be locked against opening in one direction.

The bolt mechanism controller 10 is arranged so that it will not operate again to unlock the pet door to allow a pet through it until the key transmitter 66 ceases to be detected by the bolt mechanism controller 10.

It will be appreciated by those skilled in the art that the present invention can be implemented in ways other than as described above in relation to the exemplary embodiment. In particular, the invention cam employ other methods of selecting pets allowed to pass through the pet door other than an active digitally encoded key signal. Other designs of bolt mechanism may be employed.

The pet door and bolt mechanisms may be powered exclusively by mains or battery power or a combination of both.

Whilst the present invention was devised for particular application as a dog pet door, it could also be embodied in a smaller door, such as a cat door, if desired.

What is claimed is:

1. A selectively operable pet door including a door flap pivotably mounted in an aperture of a frame, a bolt mechanism mounted in the frame which includes a bolt moveable between a locked condition in which the door flap is bolted against opening in both a forward direction and a reverse direction and an unlocked position in which the door is free to be opened, and a bolt mechanism controller which includes means for detecting a pet permitted to pass through the pet door and which is arranged to move the bolt mechanism to the unlocked condition on detecting the presence of such a pet and to automatically move the bolt mechanism back to the locked condition after a predetermined time period and which further includes a user accessible adjustment means for adjusting said predetermined time period.

2. A pet door as claimed in claim 1 in which the bolt mechanism includes first and second bolt assemblies mounted on opposite sides of a vertical centre line of the frame.

3. A pet door as claimed in claim 2 in which the first bolt assembly includes said bolt and the second bolt assembly includes a second bolt, said bolts movable to bolt and unbolt the door flap by a respective electric motor.

4. A pet door as claimed in claim 3 in which each bolt has a portion formed as a rack in engagement with a pinion rotatable by the motor.

5. A pet door as claimed in claim 4 in which the pinion is rotatable by a worm gear fixed to a rotatable drive shaft of the motor.

6. A pet door as claimed in claim 2 in which the bolt assemblies are substantially identical.

7. A pet door as claimed in claim 1 in which the bolt mechanism controller includes a tuned receiver for receiving a signal transmitted by a key transmitter worn by a pet, and a microprocessor arranged to determine from the received signal if the signal is transmitted by a key which is permitted to unbolt the pet door.

8. A pet door as claimed in claim 7 in which the microprocessor is arranged to determine if a received key signal transmitted by a key includes a predetermined digitally encoded key.

9. A pet door as claimed in claim 7, in which the microprocessor is coupled to said user accessible adjustment means by which the predetermined time period is adjustable.

10. A pet door as claimed in claim 9 in which the adjustment means includes a keypad having a first key and a second key, the predetermined time period being increased by pressing the first key and decreased by pressing the second key.

11. A pet door as claimed in claim 1 in which the length of the predetermined time period is adjustable between a predetermined minimum value and a predetermined maximum value.

12. A pet door as claimed in claim 11 in which the predetermined minimum and maximum values are 5 seconds and 60 seconds, respectively.

13. A pet door as claimed in claim 1 in which the bolt mechanism controller is arranged to move the bolt mechanism to the unlocked condition a second predetermined time period after expiry of the predetermined time period and to move the bolt mechanism to the locked condition a third predetermined time period after expiry of the second predetermined time period.

14. A pet door as claimed in claim 13 in which the second predetermined time period is 60 seconds.

15. A pet door as claimed in claim 13 in which the third predetermined time period is 1 second.

16. A selectively operable pet door comprising:

a door flap pivotably mounted in an aperture of a frame;

a bolt mechanism mounted in the frame which includes a bolt movable between a locked condition in which the door flap is bolted against opening in both a forward direction and a reverse direction and an unlocked condition in which the door flap is free to be opened; and a bolt mechanism controller configured to move said bolt mechanism between said locked condition and said unlocked condition, said bolt mechanism controller including a detection device activatable by a key adapted to be worn by a pet, wherein said bolt mechanism controller is configured to move the bolt mechanism to the unlocked condition on detecting the presence of said key and to automatically move the bolt mechanism back to the locked condition a predetermined time after being moved to the unlocked condition, said bolt mechanism controller further including a user accessible adjustment means for adjusting said predetermined time period.

17. A pet door as defined in claim 16, wherein said bolt is movable between said locked condition and said unlocked condition by an electric motor.

18. A pet door as defined in claim 16, wherein said detection device comprises a receiver adapted to receive a signal transmitted by said key.

* * * * *

UNITED STATES PATENT AND TRADEMARK OFFICE

CERTIFICATE OF CORRECTION

PATENT NO : 6,141,911

DATED : November 7, 2000

INVENTOR(S): Alister Peter Reid

It is certified that error appears in the above-identified patent and that said Letters Patent is hereby corrected as shown below:

On the title page, Item [73] the indicated assignee on the patent, GrahamWatt & Co., be deleted and the correct Assignee be inserted as follows:

Reilor Ltd., Lancashire, England

Signed and Sealed this

Thirteenth Day of February, 2001

*Attest:*

Nicholas P. Godici

NICHOLAS P. GODICI

*Attesting Officer*

*Acting Director of the United States Patent and Trademark Office*